US008210570B1

(12) United States Patent
Nagle

(10) Patent No.: US 8,210,570 B1
(45) Date of Patent: Jul. 3, 2012

(54) SKI POLE GRIP HAVING A SMOKING APPARATUS

(75) Inventor: Jesse D. Nagle, Incline Village, NV (US)

(73) Assignee: Safetybreak LLC., NY, NY (US)

( * ) Notice: Subject to any disclaimer, the term of this patent is extended or adjusted under 35 U.S.C. 154(b) by 0 days.

(21) Appl. No.: 13/136,477

(22) Filed: Aug. 1, 2011

Related U.S. Application Data

(60) Provisional application No. 61/370,003, filed on Aug. 2, 2010.

(51) Int. Cl.
*A63C 11/22* (2006.01)

(52) U.S. Cl. ..... 280/821; 131/178; 131/330

(58) Field of Classification Search ..... 280/819, 280/821, 826; 131/173, 178, 226, 260, 329, 131/330
See application file for complete search history.

(56) References Cited

U.S. PATENT DOCUMENTS

| | | | | | |
|---|---|---|---|---|---|
| 635,240 | A | * | 10/1899 | Eder | 131/181 |
| 2,502,951 | A | * | 4/1950 | Hutton | 131/182 |
| 3,443,820 | A | * | 5/1969 | Baker | 280/816 |
| 3,561,782 | A | * | 2/1971 | Tyrack | 280/816 |
| 3,705,590 | A | * | 12/1972 | Rains | 131/329 |
| 3,863,648 | A | * | 2/1975 | Cathey | 131/186 |
| 3,882,875 | A | * | 5/1975 | Frost | 131/173 |
| 4,005,872 | A | * | 2/1977 | Rischert et al. | 280/822 |
| 4,044,781 | A | * | 8/1977 | Heggestuen | 131/173 |
| 4,071,035 | A | * | 1/1978 | Boyd et al. | 131/173 |
| 4,083,374 | A | * | 4/1978 | Jacobsen | 131/178 |
| 4,134,409 | A | * | 1/1979 | McManus | 131/173 |
| 4,142,536 | A | * | 3/1979 | DeCarlo | 131/173 |
| 4,200,114 | A | * | 4/1980 | Waite | 131/178 |
| 4,204,551 | A | * | 5/1980 | Robinson | 131/178 |
| 4,229,015 | A | * | 10/1980 | Ramsey et al. | 280/819 |
| 4,244,220 | A | * | 1/1981 | Henson et al. | 374/141 |
| 4,244,602 | A | * | 1/1981 | Allsop et al. | 280/821 |
| 4,278,099 | A | * | 7/1981 | Jacobsen | 131/178 |
| 4,278,274 | A | * | 7/1981 | Ray | 280/821 |
| 4,474,191 | A | * | 10/1984 | Steiner | 131/198.2 |
| 4,478,228 | A | * | 10/1984 | Chister | 131/180 |
| 4,596,258 | A | * | 6/1986 | Steiner | 131/198.1 |
| 4,638,815 | A | * | 1/1987 | Yoshioka | 131/173 |
| 4,648,410 | A | * | 3/1987 | Seroussi | 131/173 |
| 4,732,167 | A | * | 3/1988 | Nagano | 131/198.2 |
| 4,735,218 | A | * | 4/1988 | Akiko et al. | 131/331 |
| 4,788,988 | A | * | 12/1988 | Titus | 131/198.2 |
| 5,080,113 | A | * | 1/1992 | Bui | 131/173 |
| 5,303,954 | A | * | 4/1994 | Suda | 280/819 |
| 6,260,554 | B1 | * | 7/2001 | Rowland et al. | 131/181 |
| 6,431,176 | B1 | * | 8/2002 | Rice | 131/175 |

(Continued)

*Primary Examiner* — John R Olszewski
*Assistant Examiner* — Brodie Follman
(74) *Attorney, Agent, or Firm* — Douglas Mackenzie

(57) ABSTRACT

The ski pole grip having a smoking apparatus includes a housing, a bowl piece disposed within the housing, the bowl piece including a bowl portion having a circular opening formed at a bottom thereof, a bowl plate attached to a top of the bowl piece, the bowl plate having an opening aligned with the circular opening of the bowl portion and a bowl, a smoke chamber attached to the circular opening of the bowl portion, and a retractable inhale tube closely received through the opening of the bowl plate and in the smoke chamber. Inhalation through the retractable inhale tube causes air to flow through the bowl, the bowl portion, the smoke chamber and the retractable inhale tube.

8 Claims, 6 Drawing Sheets

U.S. PATENT DOCUMENTS

| | | | | |
|---|---|---|---|---|
| 7,694,685 | B1 * | 4/2010 | Jones | 131/185 |
| 2001/0039953 | A1 * | 11/2001 | McCoy | 131/229 |
| 2002/0074006 | A1 * | 6/2002 | Gunn | 131/173 |
| 2003/0159701 | A1 * | 8/2003 | Carstens et al. | 131/173 |
| 2006/0001254 | A1 * | 1/2006 | Malone | 280/819 |
| 2009/0288670 | A1 * | 11/2009 | Lee et al. | 131/330 |
| 2009/0293888 | A1 * | 12/2009 | Williams et al. | 131/178 |
| 2010/0263681 | A1 * | 10/2010 | Zhao | 131/173 |
| 2011/0088706 | A1 * | 4/2011 | Badawi | 131/173 |
| 2011/0317404 | A1 * | 12/2011 | Gorey et al. | 362/183 |

* cited by examiner

SKI POLE GRIP HAVING A SMOKING APPARATUS

CROSS REFERENCE TO RELATED APPLICATION

The present invention claims priority from provisional patent application Ser. No. 61/370,003 filed on Aug. 2, 2010 and entitled "Pipe that is discreetly built into the handle of a ski pole grip, it is functional as a ski pole and a pipe", the disclosure of which is incorporated herein by reference.

BACKGROUND OF THE INVENTION

The present invention relates generally to pipes for smoking combustible materials and more particularly to a ski pole grip having a smoking apparatus.

Skiing is a popular winter sport in which skiers strap skis to their feet to enable them to slide upon snowy surfaces such as snow-covered mountain slopes and other terrain. Skiers use ski poles for many purposes including pole plants, avalanche testing, pointing and picking things out of the snow. Generally, ski poles include a grip at an end thereof designed to aid the skier in grasping and holding onto the ski pole. Conventional ski pole grips are made of an elastomeric material.

Skiers generally do not smoke combustible materials while skiing, but many skiers enjoy smoking during breaks from skiing and touring. The rigors of the sport require however that skiers carry a minimum of equipment and skiers find themselves in many situations without their favorite smoking pipe.

The present invention comprises a ski pole grip having an integral smoking apparatus that solves this problem and provides additional advantages.

SUMMARY OF THE INVENTION

In accordance with an embodiment of the invention, the ski pole grip having a smoking apparatus includes a housing, the housing having an opening formed at a bottom thereof sized and configured to closely receive a top end of a ski pole, a bowl piece disposed within the housing, the bowl piece having a bowl portion, a latch portion and a circular opening formed at a bottom thereof, a bowl plate attached proximate a top of the bowl piece, the bowl plate having a female latch portion, an opening aligned with the circular opening of the bowl piece and a bowl, a smoke chamber attached in communication with the circular opening of the bowl piece, and a retractable inhale tube closely received through the opening of the bowl plate and extendable within the smoke chamber. Inhalation through the retractable inhale tube causes air to flow through the bowl, the bowl portion of the bowl piece, the smoke chamber and out the retractable inhale tube There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended herein.

In this respect, before explaining at least one embodiment of the invention in detail, it is to be understood that the invention is not limited in its application to the details of design and to the arrangement of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other devices for carrying out the several purposes of the present invention. It is important, therefore, that the claims be regarded as including such equivalent devices insofar as they do not depart from the spirit and scope of the present invention.

BRIEF DESCRIPTION OF THE DRAWINGS

The present disclosure may be better understood and its numerous features and advantages made apparent to those skilled in the art by referencing the accompanying drawings wherein.

DETAILED DESCRIPTION OF THE INVENTION

Figure 1:
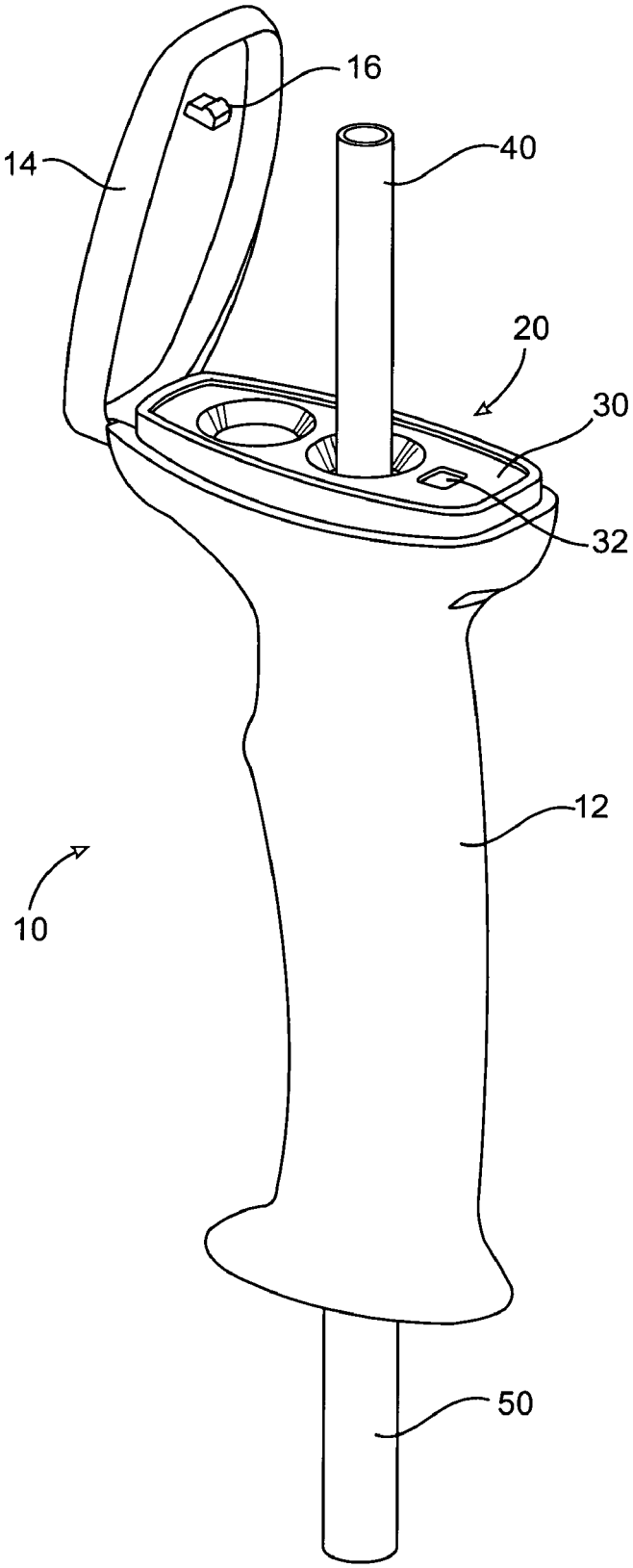
FIG. 1 is a perspective view of the ski pole grip having a smoking apparatus in accordance with the invention.
Figure 2:
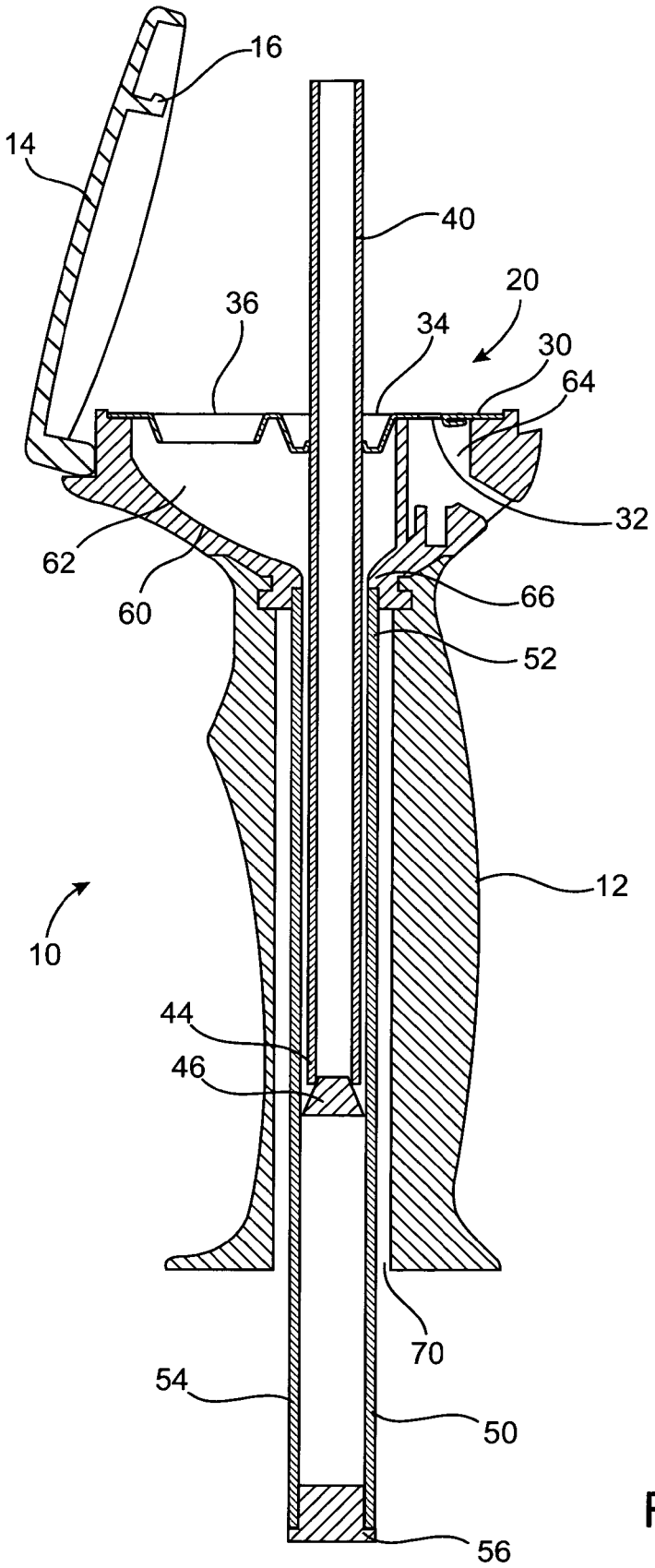
FIG. 2 is a cross sectional view of the ski pole grip of FIG. 1.
Figure 3:
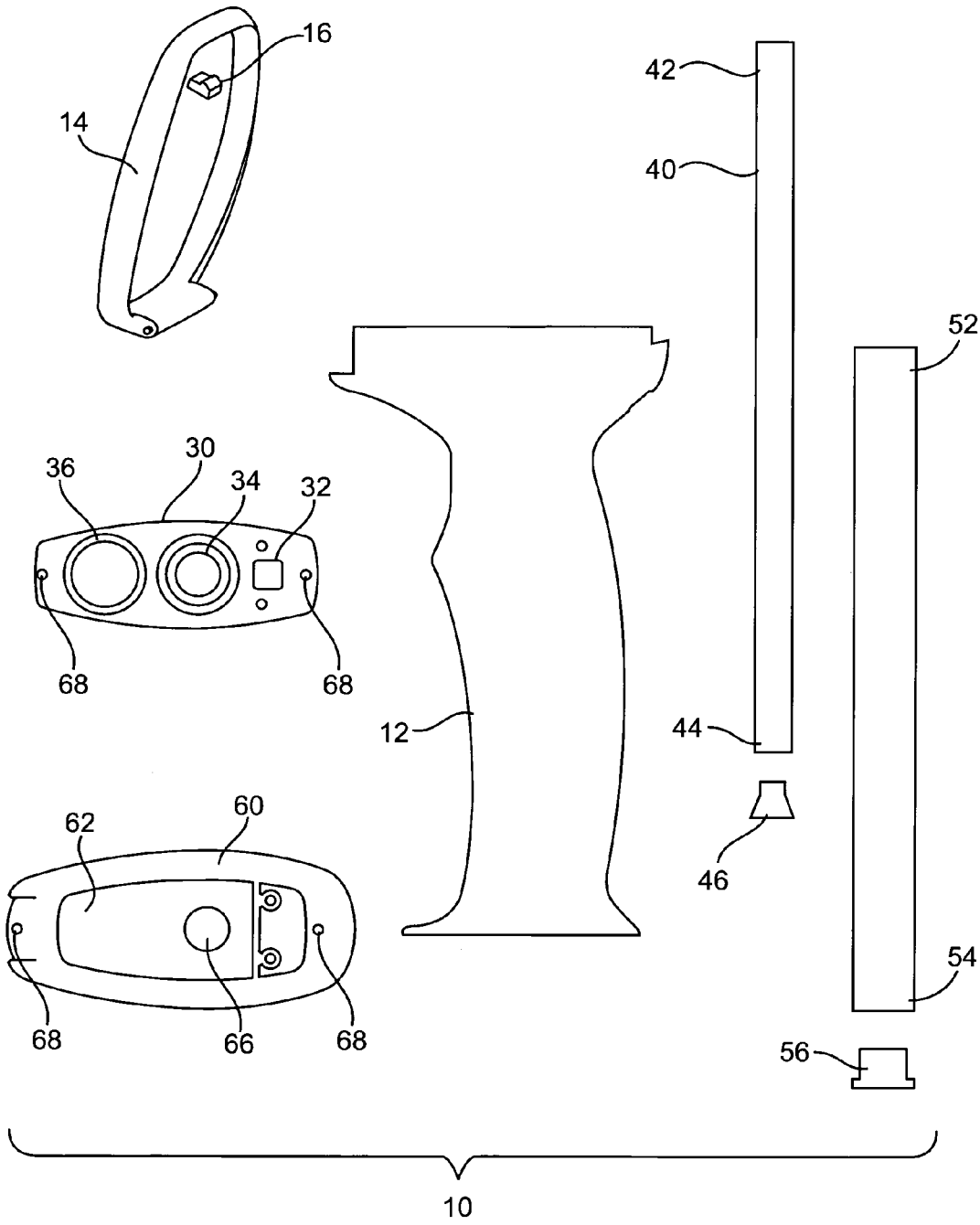
FIG. 3 is a an exploded view of the ski pole grip of FIG. 1.
Figure 4:
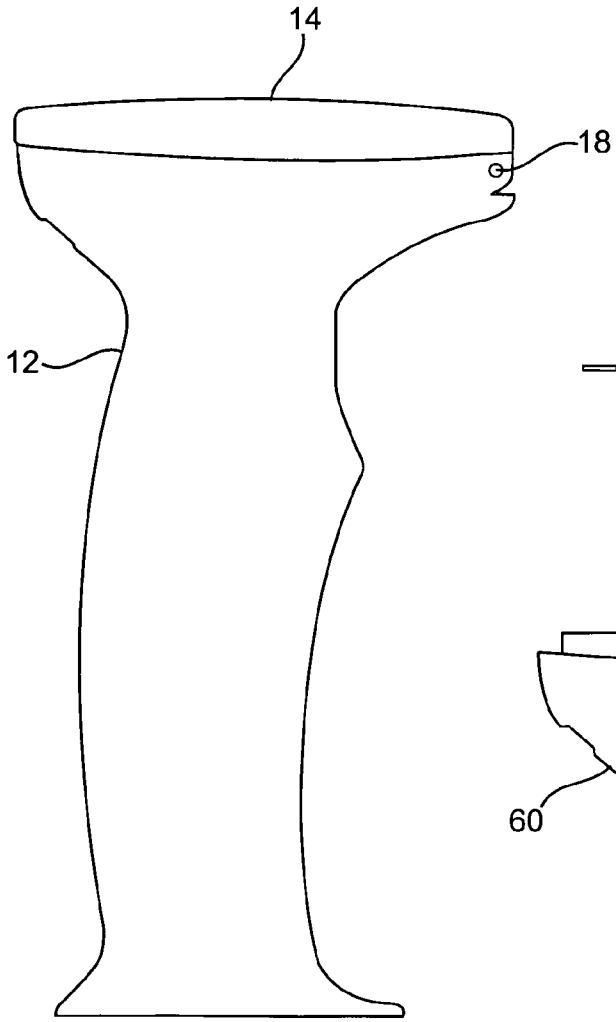
FIG. 4 is a side elevation view of the ski pole grip of FIG. 1.
Figure 6:
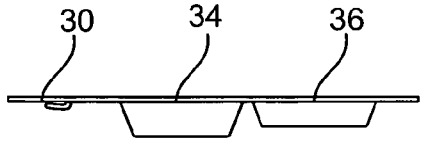
FIG. 6 is a side elevation view of a bowl plate of the ski pole grip of FIG.
Figure 5:
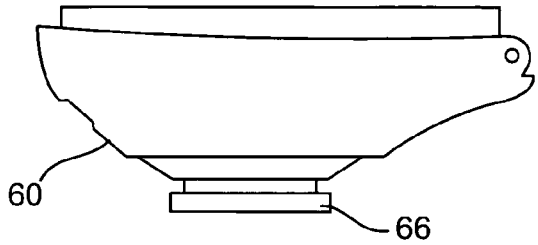
FIG. 5 is a side elevation view of a bowl piece of the ski pole grip of FIG. 1.

A ski pole grip having a smoking apparatus generally designated 10 in accordance with the principles of the invention will now be described with reference to FIGS. 1-6. The ski pole grip having a smoking apparatus 10 includes a housing 12 of conventional shape and is formed of thermoplastic rubber having a hardness of 60 shore A. The housing 12 has a conventional exterior ski pole grip shape and an opening 70 (FIG. 2) sized and configured to closely receive the top end of a ski pole (not shown).

A smoking apparatus 20 disposed in the housing 12 comprises a bowl piece 60, a bowl plate 30 attached to the bowl piece 60, a retractable inhale tube 40 and a smoke chamber 50. The bowl piece 60 is preferably molded into the housing 12.

The bowl piece 60 is preferably made of stainless steel and has a bowl portion 62 and a latch portion 64. The bowl portion 62 and the latch portion 64 provide are not in fluid communication with each other. The bowl portion 62 is open at a top thereof and has a circular opening 66 at a bottom thereof sized to closely receive a top 52 of the smoke chamber 50. The latch portion 64 has three spaced apart screw holes 68 for securing the bowl plate 30 to the top of the bowl piece 60. Another screw hole 68 is formed distally of the latch portion 64 adjacent to the bowl portion 62.

The bowl plate 30 is preferably made of 0.6 mm stainless steel and is sized and configured to overlay the bowl piece 60. The bowl plate 30 has a female latch portion 32, a retractable inhale tube opening 34 and a bowl 36. When attached to the bowl piece 60 (by means of screws), the bowl plate 30 is positioned such that the retractable inhale tube opening 34 is disposed in line with the circular opening 66 of the bowl piece 60. This alignment provides for unrestricted movement of the retractable inhale tube 40 within the smoke chamber 50 and through the retractable inhale tube opening 34.

The retractable inhale tube 40 is preferably made of acrylonitrile butadiene styrene and is closely received through the retractable inhale tube opening 34 so that inhalation through the retractable inhale tube 40 is effective in drawing air through the smoke chamber 50, the bowl portion 62 and the bowl 36. The retractable inhale tube 40 includes a conical expander 46 formed of acrylonitrile butadiene styrene having a slightly larger diameter than the inside diameter of the retractable inhale tube 40. The conical expander 46 is positioned at an end 44 of the retractable inhale tube 40 and prevents the end 44 from escaping the retractable inhale tube opening 34.

The smoke chamber 50 is preferably made of acrylonitrile butadiene styrene and has a circular cross section. The smoke chamber 50 includes a plug 56 formed of acrylonitrile butadiene styrene disposed at an end 54 thereof. The plug 56, in combination with the attachment of an end 56 of the smoke chamber 50 to the circular opening 66 of the bowl piece 60, provides for an air-tight enclosure. The smoke chamber 50 is received within the top end of the ski pole (not shown) when in use.

The bowl 36 is sized and configured to receive a smoking mixture (not shown) and is disposed over the bowl portion 62 of the bowl piece 60. Combustion of the smoking mixture and inhalation through an end 42 of the retractable inhale tube 40 enables a skier to enjoy a smoke while taking a break from skiing or touring. Inhalation through the end 42 draws air through the bowl 36, the bowl portion 62, the smoke chamber 50 and the retractable inhale tube 40.

A nylon lid 14 is hingedly attached to the bowl piece 60 by means of a pin 18 (FIG. 4) and tightly covers a top of the housing 12 and the smoking apparatus 20 when closed to prevent snow, ice, water and other debris from entering the smoking apparatus 20. A male latch portion 16 is formed on a bottom of the lid 14 and is latchedly receivable in the female latch portion 32 of the bowl plate 30.

Figure 7:
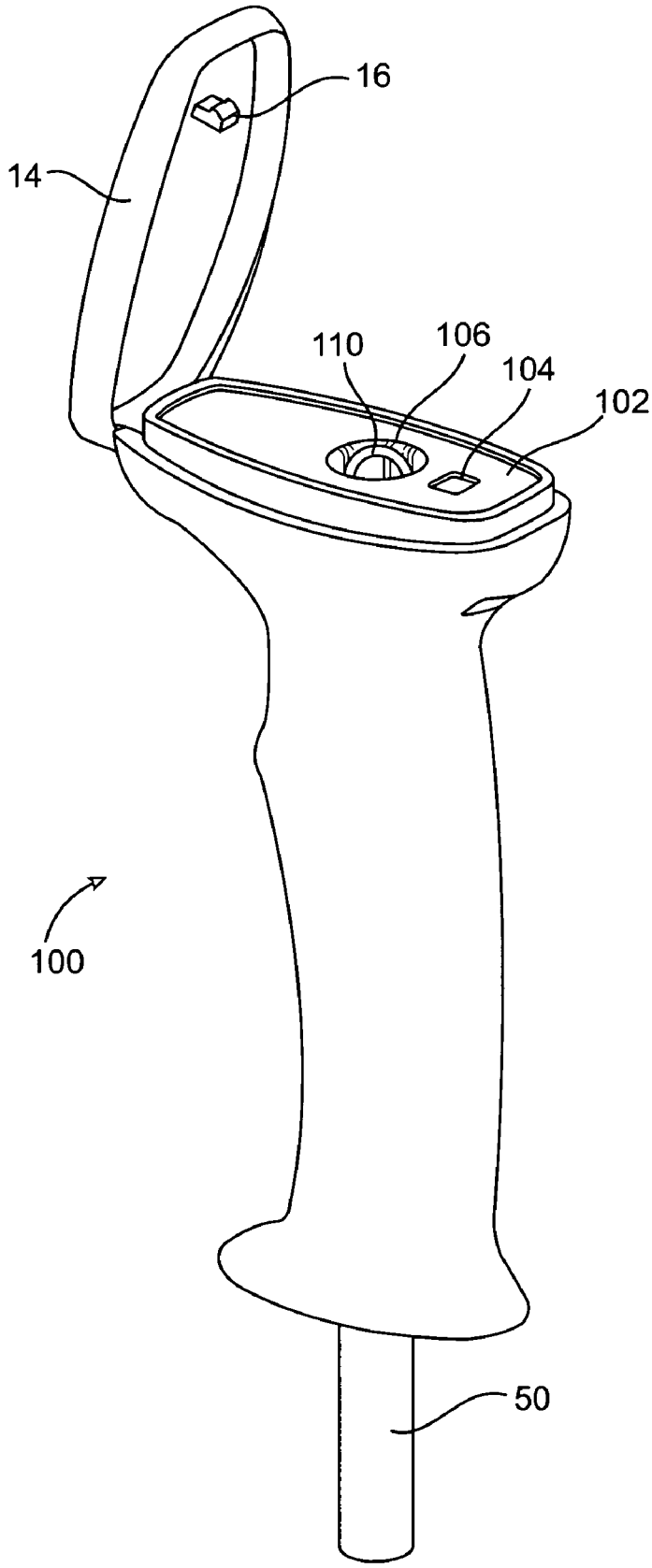
FIG. 7 is a perspective view of an alternative embodiment of the invention.
Figure 8:
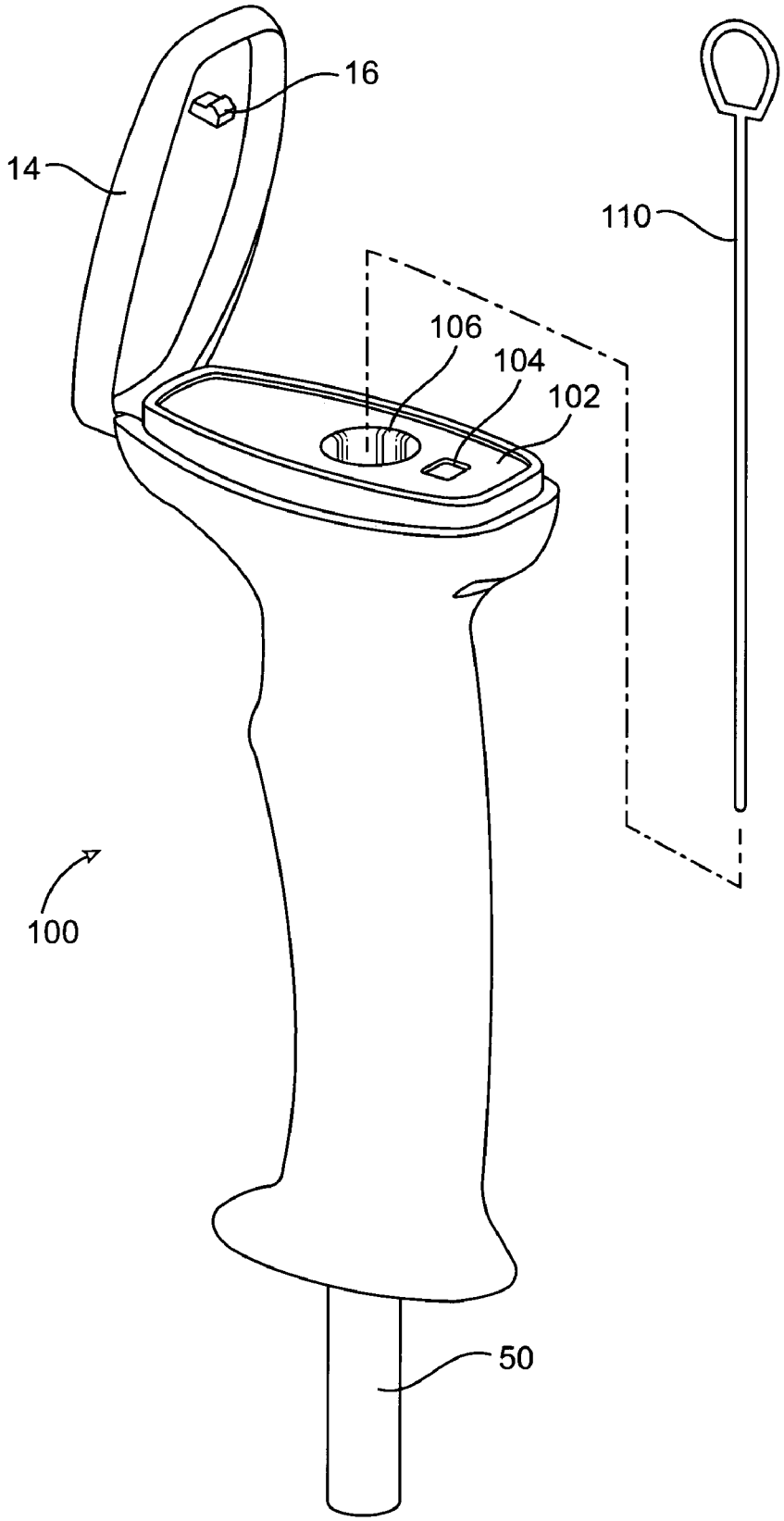
FIG. 8 is an exploded view of the embodiment of FIG. 7.

In an alternative embodiment of the invention, and with reference to FIG. 7, a ski pole grip generally designated 100 is in all respects equivalent to the ski pole grip having a smoking apparatus 10 with the exception that no retractable inhale tube is provided, the bowl plate 30 is replaced with a plate 102 and a poker 110 is provided. The plate 102 has a female latch portion 104 and an opening 106 aligned with the longitudinal axis of the smoke chamber 50. The opening 106 is sized to receive the poker 110. The poker 110 is conveniently held in the smoke chamber 50 and can be used to clean the retractable inhale tube 40, the smoke chamber 50 and the bowl portion 62 of the ski pole grip having a smoking apparatus 10.

The ski pole grip having a smoking apparatus of the invention provides a simple and unique ski pole grip that provides a combination ski pole grip and smoking apparatus. The smoking apparatus is disposed within the housing of the ski pole grip and thus relieves the skier of having to carry a pipe. The ski pole grip having a smoking apparatus is easily disassembled and allows for the removal the bowl plate, the retractable inhale tube and the smoke chamber for accessible cleaning of these components as well as the cleaning of the bowl portion of the bowl piece.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A ski pole grip having a smoking apparatus comprising:

a housing, the housing having an opening formed at a bottom thereof sized and configured to closely receive a top end of a ski pole;

a bowl piece disposed within the housing, the bowl piece having a bowl portion, a latch portion and a circular opening formed at a bottom of the bowl portion;

a bowl plate attached to a top of the bowl piece, the bowl plate having a female latch portion, an opening aligned with the circular opening and a bowl;

a smoke chamber attached to the circular opening of the bowl portion; and a retractable inhale tube closely received through the opening of the bowl plate and in the smoke chamber, inhalation through the retractable inhale tube causing air to flow through the bowl, the bowl portion of the bowl piece, the smoke chamber and the retractable inhale tube.

2. The ski pole grip of claim 1, wherein the housing is formed of thermoplastic rubber.

3. The ski pole grip of claim 1, wherein the bowl portion and the latch portion are not in fluid communication with each other.

4. The ski pole grip of claim 1, wherein the bowl piece is formed of stainless steel.

5. The ski pole grip of claim 1, wherein the bowl plate is formed of stainless steel.

6. The ski pole grip of claim 1, wherein the smoke chamber and the retractable inhale tube are formed of acrylonitrile butadiene styrene.

7. The ski pole grip of claim 1, further comprising a lid hingedly attached to the bowl piece, the lid having a male latch portion engageable with the female latch portion.

8. A ski pole grip having a smoking apparatus comprising:

a housing;

a bowl piece disposed within the housing, the bowl piece including a bowl portion having a circular opening formed at a bottom thereof;

a bowl plate attached to a top of the bowl piece, the bowl plate having an opening aligned with the circular opening of the bowl portion and a bowl;

a smoke chamber attached to the circular opening of the bowl portion; and a retractable inhale tube closely received through the opening of the bowl plate and in the smoke chamber, inhalation through the retractable inhale tube causing air to flow through the bowl, the bowl portion, the smoke chamber and the retractable inhale tube.

* * * * *